US005457472A

United States Patent [19]

Bjordal et al.

[11] Patent Number: 5,457,472

[45] Date of Patent: Oct. 10, 1995

[54] CORNER REFLECTOR FOR USE IN A RADAR BALLOON

[75] Inventors: Oddvar Bjordal, Flateby; Haakon Fykse, Enebakkneset, both of Norway

[73] Assignee: Baco Industrier A/S, Krisstiansund, Norway

[21] Appl. No.: 266,879

[22] Filed: Jul. 5, 1994

Related U.S. Application Data

[63] Continuation of Ser. No. 859,528, filed as PCT/NO89/00129, Dec. 11, 1989, abandoned.

[51] Int. Cl.[6] ..... H01Q 15/14

[52] U.S. Cl. ..... 343/912; 343/915; 342/8

[58] Field of Search ..... 343/912, 915, 343/705, 706; 342/5, 6, 7, 8, 9, 10; H01Q 15/14, 15/18

[56] References Cited

U.S. PATENT DOCUMENTS

| | | | |
|---|---|---|---|
| 2,463,517 | 3/1949 | Chromak | 343/18 |
| 2,888,675 | 5/1959 | Pratt et al. | 343/18 |
| 3,276,017 | 9/1966 | Mullin | 343/18 |
| 4,673,934 | 6/1987 | Gentry et al. | 343/915 |
| 4,980,688 | 12/1990 | Dozier, Jr. | 342/9 |
| 4,989,015 | 1/1991 | Chang | 343/915 |
| 4,996,536 | 2/1994 | Broadhurst | 343/912 |
| 5,097,265 | 3/1992 | Aw | 342/7 |

FOREIGN PATENT DOCUMENTS

| | | | |
|---|---|---|---|
| 0182274 | 5/1986 | European Pat. Off. | H01Q 1/08 |
| 1129192 | 5/1962 | Germany | H04P 48/63 |
| 2152785 | 2/1985 | United Kingdom | H04R 3/00 |

*Primary Examiner*—Donald Hajec
*Assistant Examiner*—Tan Ho
*Attorney, Agent, or Firm*—Cushman Darby & Cushman

[57] ABSTRACT

A balloon with an internal corner reflector for radio waves is built with the reflecting plane of the reflector freely suspended from a cord frame system which is only secured in the points of suspension. The reflector is suspended inside a balloon which is composed of single flat pieces of a resilient material. Manufacture of the reflector balloon may substantially be done in one plane and the balloon primarily envelopes the reflector very tightly. The suspension utilizes the resiliency of the balloon corners. Balloons which are observed from below may have four internal corners with downwards facing openings and may also be designed to provide rotation.

4 Claims, 4 Drawing Sheets

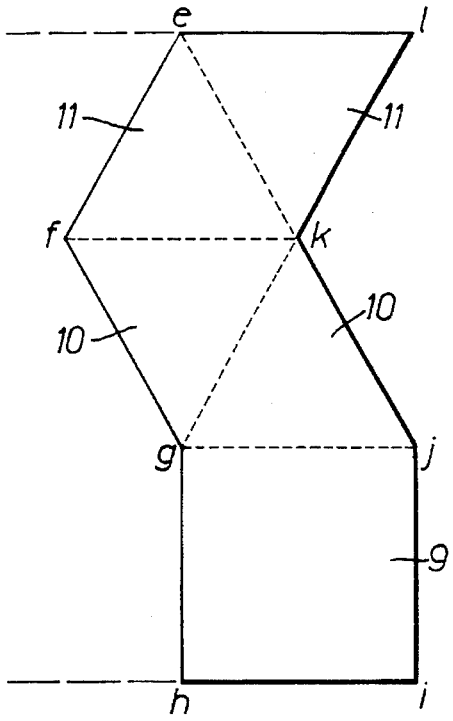
Fig.6.
Fig.7.
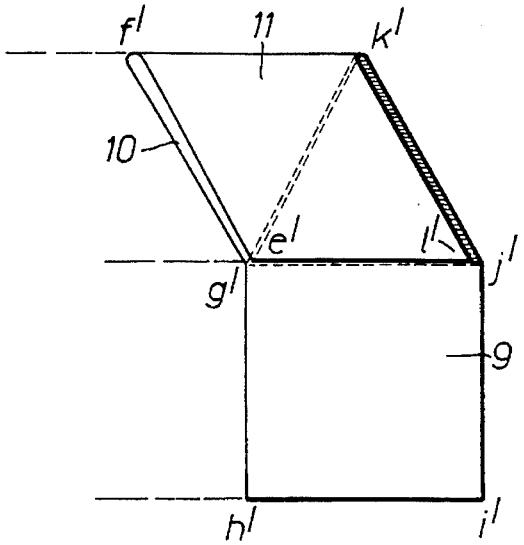
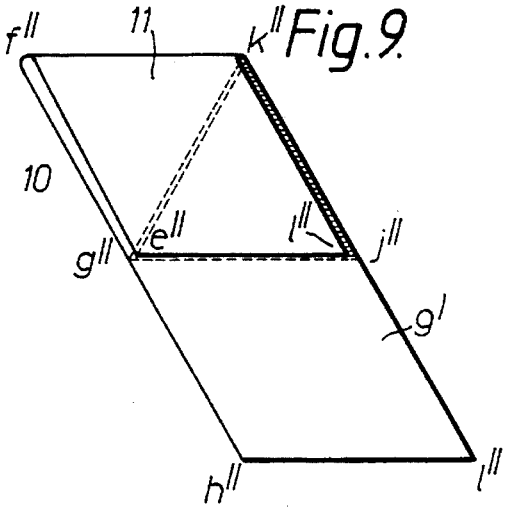
Fig.9.
Fig.10.
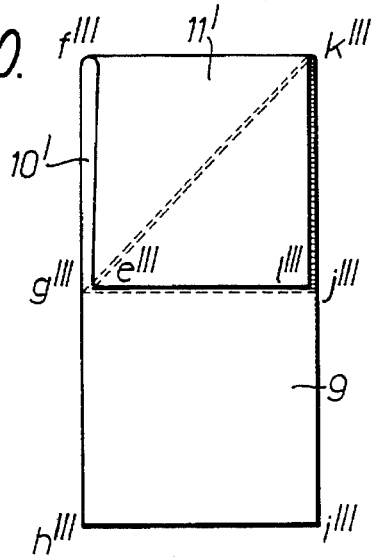
Fig.11.
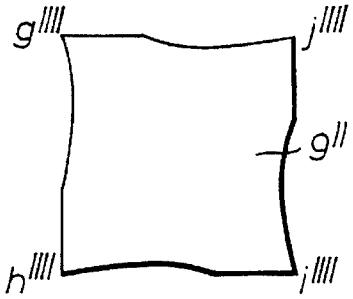

CORNER REFLECTOR FOR USE IN A RADAR BALLOON

This is a continuation of application Ser. No. 07/859,528, filed as PCT/NO89/00/29, Dec. 11, 1989, now abandoned.

BACKGROUND OF THE INVENTION

The present invention relates to a corner reflector for use in a radar balloon, especially for use in measuring meteorological parameters, furthermore, for use as a radar marker, e.g. in life-saving service and for other objects.

As regards known technology in the Art, we especially refer to U.S. Pat. Nos. 2,465,517, 2,888,675, and 3,276,017, DE-PS 1 129 192, and GB-publ. 2 152 785.

All mentioned publications are more or less concerned with the object which the present invention intends to achieve, however, they fail to do so.

A radar balloon should provide the best possible reflection, at the same time as it should use a small volume of gas. The principle of placing a corner reflector in a balloon is previously known, as mentioned, but it was difficult to have the reflector fully expanded. Especially, in case of deviation from the orthogonality of various planes, efficient reflection is reduced. Expansion of the balloon when it is filled, or in connection with its ascent in the atmosphere according to known technology, may deform the reflector, and cause high mechanical loads on the structure, especially in case of meteorological balloons, which are also subjected to great variations of temperature. A freely rotating balloon may remain in a position with one plane almost in parallel with the radar beam and may, thus, provide bad or even zero reflection. A corner reflector with eight internal corners will always have half of the internal corners positioned in radar shadow.

SUMMARY OF THE INVENTION

It is an object of the present invention to improve known technology and to provide designs which in a novel manner increase the ratio between reflection/range and utilized volume of gas, and which are also simple in manufacture. The invention is based on a reflector in which the reflecting plane is suspended from a cord frame system of substantially non-elastic cords which at the same time defines the angle between planes and distends the radar reflector in the shape of a reflecting net, a cloth, a sheet, or the like, hereafter called a sheet.

Accordingly, the present invention relates to a corner reflector to be suspended in a radar balloon, and the invention is characterized by the fact that the reflector is formed by a distended, substantially non-elastic cord frame system with a reflecting sheet attached to the same, so that all three orthogonal planes are only in physical contact, via the cord frame system, and the the external nodes at the same time serve as suspension points.

The invention also relates to a balloon of a flexible material for internal suspension of the above disclosed corner reflector, which is characterized by the fact that it has at least the same number of corners as the reflector, and that they may be directly secured to the reflector to distend the reflector corners in case of gas filling and expansion.

According to the invention the cord frame system is expanded by the balloon. Each sheet member is in principle separated from the other sheet members and from the balloon cloth to be freely suspended, so that no friction will occur due to lateral forces, which might destroy the angle between various planes. The shape of the reflector is only to a very small degree influenced by variations in the tensional load from the balloon if the tensional load exceeds a certain minimum. An additional sheet area may be extended beyond the outer edges of the cord frame system by the aid of lightweight stays or profiles resting or balancing on the distended cord frame system and on the sheet.

A reflector used as a radar marker in life-saving service or as a dummy target for civil or military purposes, should have eight internal corners to be able to reflect incident radiation from all arbitrary directions.

A reflector to be used for meteorological purposes need not have more than four internal corners, since the reflector can be orientated by suitable means to make the same side always face downwards.

A balloon of the present kind is, preferably, made from single, if desired, combined webs of a resilient gastight cloth, sheet or the like, here called sheet.

The shape of the web is selected to permit the reflector to fill a finished inflated balloon as much as possible, and to permit the reflector to be suspended at the corners.

One of the attachment points may in this connection, preferably, be combined with a valve/filler neck.

Attachment at the corners provides for rapid distension of the reflector and utilizes the resiliency of part of the balloon cloth which is not otherwise subjected to great elastic loads.

In balloons which are to ascend through the atmosphere it is possible to utlize the effect that even a not fully distended reflector will not be able to provide sufficient reflection at a close range for registration, and that distension is gradually improved as the balloon ascends and expands.

Balloons which are intended for great heights may be provided with cords or the like which will adjust the expansion volume to begin with. It will, thus, be possible to achieve sufficient pressure in the balloon to distend the reflector from the start.

As mentioned above, it may be desirable in case of meteorological balloons to ensure permanent orientation in a certain direction. This may, e.g. be achieved by the aid of a weight, if desired in the shape of a probe which is suspended below the balloon, e.g. for registration of temperature and moisture.

By the aid of a suitable design of the balloon or by the aid of attached fins it is also possible to achieve controlled rotation of the balloon about a vertical axis, which will statistically provide for good reflection.

BRIEF DESCRIPTION THE DRAWINGS

The invention will be disclosed in more detail with reference to the accompanying drawings, in which FIGS. 1–3 show sheet members for the reflector with cords in a dashed line;

FIG. 6 shows a continuous and unfolded blank for a balloon;

FIG. 7 shows the same blank in a partly folded and welded design;

FIGS. 9 and 10 show variants of the balloon cloth in FIG. 7;

FIG. 11 shows a variant of the square marked ghij in FIG. 6; and

DETAILED DESCRIPTION

Figure 1:
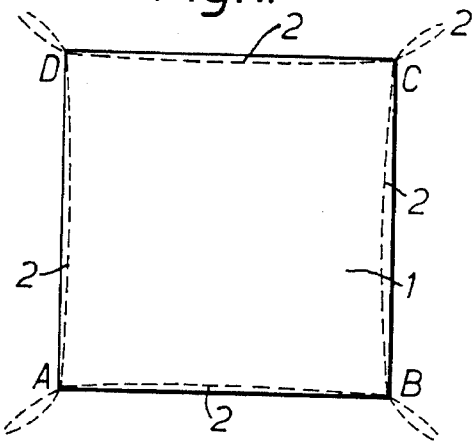

As mentioned above, it is a characterizing feature of the invention that the reflector is suspended in a substantially non-elastic cord frame system which clearly defines the positions of three orthogonally intersecting planes, and is in principle provided with the reflecting sheet, so that each plane adjusts quite freely in relation to the other planes and in a direction which is predetermined by the cord frame system. The cords may at the same time be used to tension each of the planes.

The reflecting sheet of a corner reflector according to the invention must show sufficient conductivity to provide three separate reflections. Characteristically, a 0.003 mm aluminium sheet at 9 GHz will provide approximately 0.9 times what is achievable by the aid of a thicker sheet, whereas 0.0005 mm provides 0.08 times what is theoretically achievable.

In FIGS. 1–5 the principle of a cord frame system and freely hanging sheet, as discussed above, is illustrated by an embodiment comprising a reflector with four internal corners.

Cords 2 may be secured in place on sheet members while the latter lie flat. Further mounting comprises connecting the cords from various members at the corners.

With sheet 1 forming a horizontal plane, both vertical planes are to form diagonals AC, and BD, respectively in 1.

At least one of those planes must be split along the line of intersection 6 between said two vertical planes for them to be freely tensioned in a right-angled manner.

The other vertical plane must be split at least sufficiently to permit cords 2 to be freely tensioned. Also, the cords should go in differently at points of intersection F/F' of both vertical planes, so that the cords may arrange themselves freely.

Figure 4:
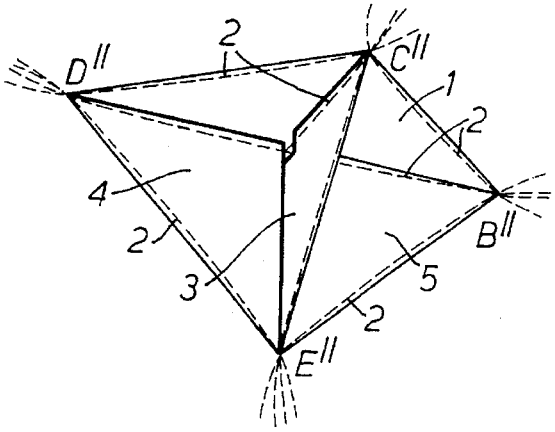
FIG. 4 shows a completed reflector.

A complete reflector, cf. FIG. 4, is achieved when B is secured to B', D to D', C to C', A to A', and E to E'. Attachment of cords is essential to the invention, since the angle betwen planes is determined by the nodes. Outside the nodes the cords may be used to suspend the reflector.

FIG. 4 shows a finished reflector in a distended state. Before it is arranged in the balloon, the vertical planes may be folded by simple folds on triangles 3–5, so that point E will sit towards the center of 1 and the remaining reflector will be in parallel with 1.

Figure 2:
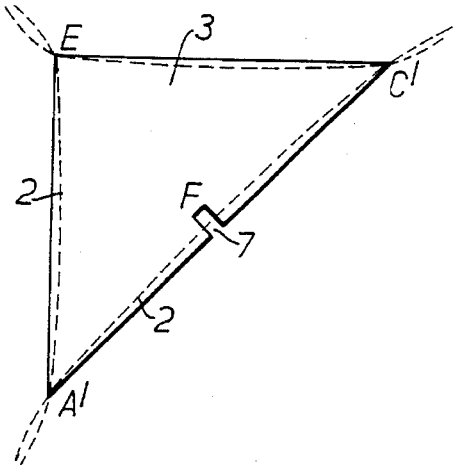
Figure 3:
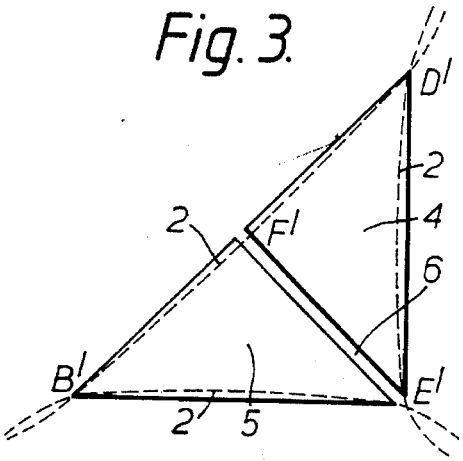

Another variant of the reflector according to the invention may be achieved by substituting triangle 3 in FIG. 2 by corresponding members 4 and 5 in FIG. 3. By placing an additional set of triangles in FIGS. 2 and 3 symmetrically to sheet 1, a reflector with eight internal corners achieved.

Figure 5:
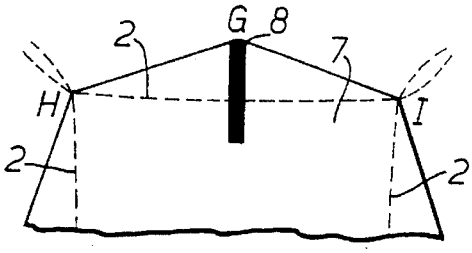
FIG. 5 shows a distension of the reflector area.

The shape of members is not limited to the shape indicated in FIGS. 1–4, as long as orthogonality is maintained. FIG. 5, thus, shows a possibility of increasing the active area when the distance between points of suspension is given. Instead of cutting the sheet along straight line HI, a stay 8 is attached to the sheet, which will, in turn, balance on cord 2, so that an additional area GHI is achieved which is in the same plane with the remaining sheet 7. The reflector enlargement may be used along all external edges of the reflector, and one or a number of stays may also be used along each edge.

Another embodiment for enlarging the reflector area is achieved by stretching cords 2 by the aid of small frames close to the point of suspension. These frames will absorb tension of the cords to ensure the same tension as if the cords had extended to their tie-up points. The frames may be plates or frames with three or four corners.

An essential feature of the balloon according to the present invention is that it consists of single and, If desired, connected plane members of a resilient material, and that the edges to be secured to close the balloon have equal lengths in pairs, and that corners are shaped which may serve as points of attachment for the reflector.

Balloon corners may be attached directly to reflector corners so that the balloon corners are retracted when the balloon expands. In this manner the resiliency of the balloon cloth may be utilized in an area which is not otherwise subjected to great tensional loads due to expansion.

The shapes of faces may be selected from manufacturing considerations, and based on the concept that the balloon should sit as tightly as possible around the reflector to reduce the utilized volume of gas.

A balloon of the same original shape as the reflector of FIG. 4 may be manufactured from a running web of cloth, as shown in FIG. 6.

FIG. 7 shows the same cloth in a folded state along f'k' and, furthermore, welded along k'(l'/j'). For manufacture, the cloth may be folded in such a manner that pieces are cut for the balloon directly in the shape as shown in FIG. 7.

Another possibility in case of difficulties in procurement of wide cloth, may be to let one or both squares g'h'l'j', and e'f'k'l' be manufactured separately to be welded to square f'g'j'k' to form the shape as shown in FIG. 7.

The reflector may be mounted in the balloon by providing a plane folded reflector in the centre of square g'h'j'k' with reflector corners and securing cords facing the corners of the cloth. E" will sit centrally on the square and is attached to k' by lifting e' and pulling k' to E" and joining.

Securing in k' may suitably be combined with securing a valve/filler neck.

The balloon is finished tightly by e' being pulled to i' and f' to h', followed by welding along g'(h'/f')(i'/e')-(j'/l').

Cords from the corner reflector may be attached to the balloon corners by binding, clamping, glueing, welding or attaching in another manner. The cords there may, suitably be provided with small spheres, knots or the like to facilitate securing operations. By evacuating remaining air a balloon is, thus, achieved which can readily be packed and transported to the site of application.

A distinctive feature is that the manufacturing operation mainly occurs in one plane.

Figure 8:
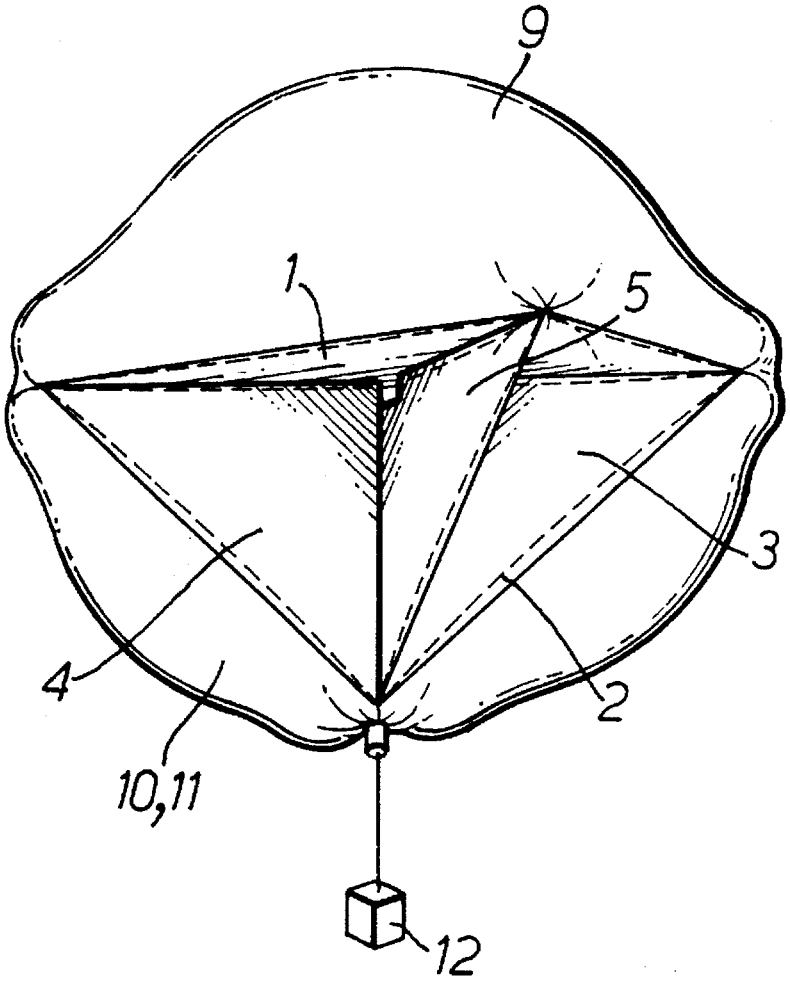
FIG. 8 shows a finished balloon with reflector and probe.

An inflated radar balloon with a probe, or a stabilizing weight 12, respectively, is shown in FIG. 8. After inflation the balloon will look approximately like a sphere with inwards curved points of attachment.

Variants of a cloth blank, as shown in FIG. 7, are shown in FIGS. 9 and 10. Inter alia, they are advantageous in that they are simple and may be manufactured from a narrow straight running web. In FIG. 9 square g'h'i'j' is reduced to a parallelogram g"h"i"j", and in FIG. 10 parallelograms e'f'k'l' and g'f'k'j' are reduced to a square e'"f"k'" l'", and g'"f"k'"l'". Manufacture of the balloon may be quite analogous with that of the cloth blanks in FIG. 7, and for the rest similar variants are, obviously, true.

The detail shown in FIG. 11 shows another variant of square g""h""i""j"". The distinct feature of this embodiment is a possibility of achieving rotation by the aid of rotational symmetry about a central normal so that the balloon will rotate during its ascent.

Complete symmetry is not critical, provided that the balloon is made to rotate sufficiently and remains relatively stable. In the same manner as for squares, other dynamically balanced details may be arranged in other places of the balloon by design of the cloth blank, in welding operations, or by securing fins or the like.

Figure 12:
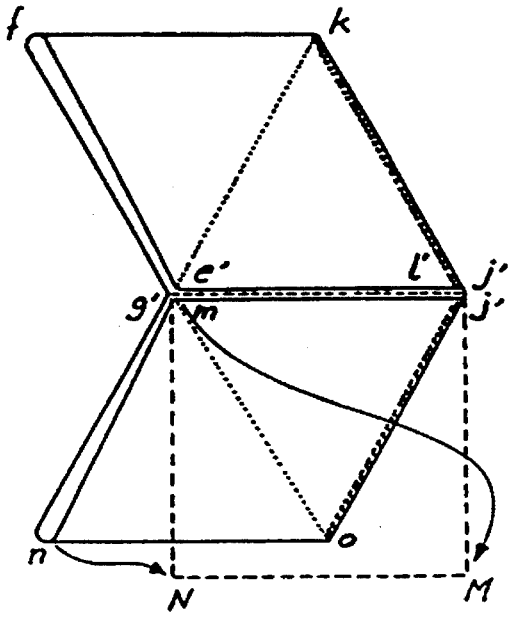
FIGS. 12 and 13 show a balloon blank for a reflector having eight internal corners.

A balloon with eight internal reflector corners has six points of attachment. In the same manner as the reflector, the balloon may also be made symmetrical about a corresponding plane of mirror symmetry, closer to what would otherwise be the corresponding square ghij. Starting with the cloth blank in FIG. 7, the square may be replaced by a piece making the balloon blank symmetrical about a plane normal to the paper along line gj, as shown in FIG. 12.

The opening between e'l' and mJ' is most advantageous in mounting, as compared to a blank with the same extent where e'l'and ml' are continuous. When m is displaced to M, and n to N, as shown by arrows in FIG. 12, it is immediately possible to recognize the circumference of the blank in FIG. 7. A corner of the reflector is attached to o and the reflector is laid down on square g'NMj' in a manner corresponding to that mentioned above regarding square g'h'i'j'. Further mounting operations may correspond to what is indicated as regards the cloth blank shown in FIG. 7.

Alternative shapes may also be used, e.g. as shown in FIGS. 9 and 10, and this may, furthermore, be combined with various designs as regards the two halves divided by gj', and individually with each of the flat pieces.

Figure 13:
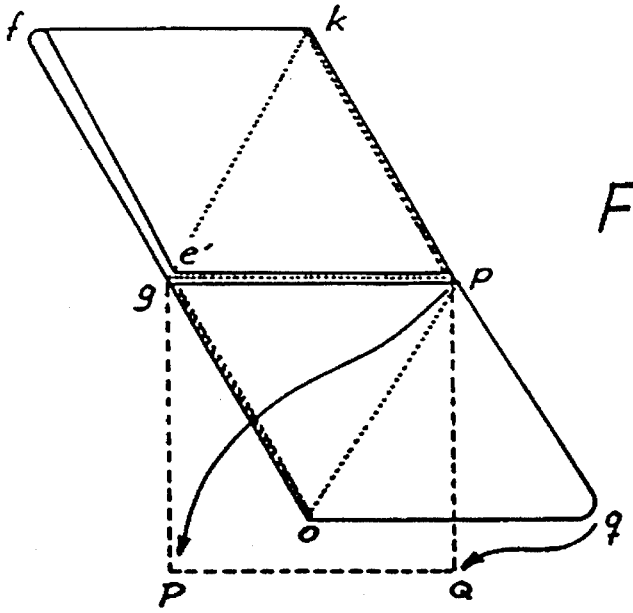

In FIG. 13 an additional variant is shown. Arrows indicate how the same circumference as in FIG. 7 may be achieved using he above-mentioned mounting.

We claim:

1. A corner reflector suspended in a volume-expansible buoyant balloon, comprising:

a volume-expansible buoyant balloon having a plurality of cord end connection attachment points located at distributed sites on a peripheral skin of the balloon;

a corner reflector disposed within a volume of space enclosed by said balloon;

said corner reflector including:

at least three sheets of electromagnetic energy-reflective material arranged to be disposed in mutually orthogonal planes so as to define at least four internal corners, and at least five outer peripheral nodes, at each of which a respective at least two of said sheets are juxtaposed and come to an end at a respective site on the outer periphery of said corner reflector;

a substantially non-elastic cord frame system including a plurality of non-elastic cords each extending between a respective two adjacent ones of said nodes, such that all pairs of adjacent nodes are associated with opposite ends of respective non-elastic cords;

all of said ends of said non-elastic cords at each node being secured to one another to form a respective cord end connection;

each said cord end connection being attached at a respective one of said attachment points to said peripheral skin of said volume-expansible buoyant balloon;

said sheets of electromagnetic energy-reflective material having respective edge margins extending between each two perimetrically adjoining ends thereof;

respective ones of said non-elastic cords being secured to respective ones of said sheets near respective ones of said edge margins such that upon tensioning of all of said non-elastic cords to at least a given amount by outward pulling on all of said cord end connections such as would result from volumetric expansion of said space within said balloon by a given amount, said sheets of electromagnetic energy-reflective material thereby become disposed in mutually orthogonal planes and become in physical contact only via said non-elastic cord frame system; and said peripheral skin of said balloon being multicornered, and having as many corners as said corner reflector has cord end connections, each said corner of said peripheral skin providing a respective one of said attachment points.

2. The apparatus of claim 1, wherein:

said balloon is an assembled structure comprised of a plurality of panel blanks seamed to one another along respective edges thereof.

3. The apparatus of claim 1, wherein:

said balloon further includes an inlet structure useable for inflating said balloon with a gas, said inlet structure being provided at a respective one of said corners of said peripheral skin.

4. The apparatus of claim 1, floating in air and being oriented with four of said internal corners aimed downwards.

* * * * *